United States Patent [19]

Piper et al.

[11] Patent Number: 4,844,820

[45] Date of Patent: Jul. 4, 1989

[54] LIQUID FABRIC SOFTENER COMPRISING LIGHT-UNSTABLE RED DYE IN PROTECTIVE PACKAGE

[75] Inventors: Heidi A. Piper; Errol H. Wahl; Aivars I. Vimba, all of Cincinnati, Ohio

[73] Assignee: The Procter & Gamble Company, Cincinnati, Ohio

[21] Appl. No.: 213,373

[22] Filed: Jun. 30, 1988

Related U.S. Application Data

[63] Continuation-in-part of Ser. No. 168,369, Mar. 15, 1988, abandoned.

[51] Int. Cl.[4] ..... D06M 00/00

[52] U.S. Cl. ..... 252/8.6; 8/137; 252/8.75; 252/8.8

[58] Field of Search ..... 252/8.6, 8.75, 8.8

[56] References Cited

U.S. PATENT DOCUMENTS 3,892,669 7/1975 Rapisarda et al. ..... 252/8.75

4,348,305 9/1982 Hennemann et al. ..... 252/8.8

*Primary Examiner*—A. Lionel Clingman

*Attorney, Agent, or Firm*—Robert B. Aylor; Richard C. Witte

[57] ABSTRACT

Liquid fabric softening composition for use in a rinse bath after washing fabrics with a detergent. The softening composition has a pH of less than about 7 and contains light-unstable red dyes especially D&C Red #28, to provide a pink color, the softening composition being packaged in a container that protects the dye from light. Light destroys the dye on fabrics, equipment, etc. to avoid dye build-up.

12 Claims, No Drawings

LIQUID FABRIC SOFTENER COMPRISING LIGHT-UNSTABLE RED DYE IN PROTECTIVE PACKAGE

CROSS-REFERENCE TO RELATED APPLICATION

This is a continuation-in-part of our copending application, U.S. Ser. No. 07/168,369, filed Mar. 15, 1988, for Liquid Fabric Softener.

TECHNICAL FIELD

This invention relates to compositions and methods for softening fabrics during the rinse cycle of laundering operations, e.g., in the home. This is a widely used practice to impart to laundered fabrics a texture or hand that is smooth, pliable and fluffy to the touch (i.e., soft).

Liquid fabric softening compositions have long been known in the art and are widely utilized by consumers during the rinse cycles of automatic laundry operations. The term "fabric softening" as used herein and as known in the art refers to a process whereby a desirably soft hand and fluffy appearance are imparted to fabrics.

BACKGROUND ART

Compositions containing cationic nitrogenous compounds in the form of quaternary ammonium salts and substituted imidazolinium salts having two long chain acyclic aliphatic hydrocarbon groups are commonly used to provide fabric softening benefits when used in laundry rinse operations (See, for example, U.S. Pat. Nos. 3,644,203, Lamberti et al., issued Feb. 22, 1972; and 4,426,299, Verbruggen, issued Jan. 17, 1984; also "Cationic Surface Active Agents as Fabric Softeners," R. R. Egan, Journal of the American Oil Chemists' Society, January 1978, pages 118–121; and "How to Choose Cationics for Fabric Softeners," J. A. Ackerman, Journal of the American Oil Chemists' Society, June 1983, pages 1166–1169).

Quaternary ammonium salts having only one long chain acyclic aliphatic hydrocarbon group (such as monostearyltrimethyl ammonium chloride) are less commonly used because for the same chain length, compounds with two long alkyl chains were found to provide better softening performance than those having one long alkyl chain. (See, for example, "Cationic Fabric Softeners," W. P. Evans, Industry and Chemistry, July 1969, pages 893–903). U.S. Pat. No. 4,464,272, Parslow et al., issued Aug. 7, 1984, also teaches that monoalkyl quaternary ammonium compounds are less effective softeners.

Another class of nitrogenous materials that are sometimes used in fabric softening compositions are the non-quaternary amide-amines. A commonly cited material is the reaction product of higher fatty acids with hydroxy alkyl alkylene diamines. An example of these materials is the reaction product of higher fatty acids and hydroxyethylethylenediamine (See "Condensation Products from $\beta$-Hydroxyethylethylenediamine and Fatty Acids or Their Alkyl Esters and Their Application as Textile Softeners in Washing Agents," H. W. Eckert, Fette-Seifen-Anstrichmittel, September 1972, pages 527–533). These materials are usually cited generically along with other cationic quaternary ammonium salts and imidazolinium salts as softening actives in fabric softening compositions. (See U.S. Pat. Nos. 4,460,485, Rapisarda et al., issued July 17, 1984; 4,421,792, Rudy et al., issued Dec. 20, 1983; 4,327,133, Rudy et al., issued Apr. 27, 1982). U.S. Pat. No. 3,775,316, Berg et al., issued Nov. 27, 1973, discloses a softening finishing composition for washed laundry containing (a) the condensation product of hydroxyalkyl alkylpolyamine and fatty acids and (b) a quaternary ammonium compound mixture of (i) from 0% to 100% of quaternary ammonium salts having two long chain alkyl groups and (ii) from 100% to 0% of a germicidal quaternary ammonium compound of the formula $[R_5R_6R_7R_8N]^+A-$ wherein $R_5$ is a long chain alkyl group, $R_6$ is a member selected from the group consisting of arylalkyl group and $C_3$–$C_{18}$ alkenyl and alkadienyl containing one or two C=C double bonds, $R_7$ and $R_8$ are $C_1$–$C_7$ alkyl groups, and A is an anion. U.S. Pat. No. 3,904,533, Neiditch et al., issued Sept. 9, 1975, teaches a fabric conditioning formulation containing a fabric softening compound and a low temperature stabilizing agent which is a quaternary ammonium salt containing one to three short chain $C_{10}$–$C_{14}$ alkyl groups; the fabric softening compound is selected from a group consisting of quaternary ammonium salts containing two or more long chain alkyl groups, the reaction product of fatty acids and hydroxyalkyl alkylene diamine, and other cationic materials.

SUMMARY OF THE INVENTION

The present invention relates to fabric softening compositions in aqueous liquid form for use in laundry operations, especially in the home. The present invention is based on the discovery that certain red dyes are capable of imparting a stable color, preferably pink, to such a product when the pH is lower than about 7, preferably lower than about 4, if the dye is protected from light, and the danger of staining fabrics is substantially reduced. It is especially surprising that D&C Red #28 can be used in such compositions having a pH lower than about 4 since it is known to be precipitated out of water at a pH of less than about 4.

According to the present invention, a fabric softening composition is provided in the form of an aqueous dispersion comprising from about 3% to about 35% by weight of fabric softener, and from about 1 ppm to about 1,000 ppm, preferably from about 2 ppm to about 200 ppm of a dye system comprising certain lightunstable red dyes, especially D&C Red #28, the pH of the undiluted composition being less than about 7, preferably less than about 4, more preferably from about 2 to about 4, most preferably from about 2.5 to about 4.

DETAILED DESCRIPTION OF THE INVENTION

The amount of fabric softening agent in the compositions of this invention is typically from about 3% to about 35%, preferably from about 4% to about 27%, by weight of the composition. The lower limits are amounts needed to contribute effective fabric softening performance when added to laundry rinse baths in the manner which is customary in home laundry practice. The higher limits are suitable for concentrated products which provide the consumer with more economical usage due to a reduction of packaging and distributing costs.

The preferred compositions are disclosed in U.S. Pat. No. 4,661,269, issued Apr. 28, 1987, in the names of Toan Trinh, Errol H. Wahl, Donald M. Swartley and Ronald L. Hemingway, said patent being incorporated herein by reference.

THE COMPOSITION

The fabric softening composition comprises the following components:

I. from about 3% to about 35%, preferably from about 4% to about 27%, by weight of the total composition of a fabric softener;

Preferably the fabric softener is a mixture comprising:

(a) from about 10% to about 92% of the reaction product of higher fatty acids with a polyamine selected from the group consisting of hydroxyalkylalkylenediamines and dialkylenetriamines and mixtures thereof;

(b) from about 8% to about 90% of cationic nitrogenous salts containing only one long chain acyclic aliphatic $C_{15}$–$C_{22}$ hydrocarbon group; and optionally, (c) from 0% to about 80% of cationic nitrogenous salts having two or more long chain acyclic aliphatic $C_{15}$–$C_{22}$ hydrocarbon groups or one said group and an arylalkyl group; said (a), (b) and (c) percentages being by weight of Component I;

II. from about 1 ppm to about 1,000 ppm, preferably from about 2 ppm to about 200 ppm of a dye system comprising a visible amount of a light-unstable dye selected from the group consisting of D&C Reds #'s 21, 22, 27 and 28; FD&C Reds #'s 2 and 3; C.I. Acid Reds #'s 14 and 51; and mixtures thereof; and III. the balance of the composition comprising a liquid carrier selected from the group consisting of water and mixtures of the water and $C_1$–$C_4$ monohydric alcohols, the pH of the undiluted composition being less than about 7, preferably less than about 4, more preferably from about 2 to about 4, and the said fabric softening composition being packaged in a container that protects said dye system II from light.

As used herein, Component I comprises the mixture of fabric softening actives.

Following are the general descriptions of the essentials and optionals of the present compositions including a specific example. The example is provided herein for purposes of illustration only and is not intended to limit the claims, unless otherwise specified.

THE DYE

Dyes that are useful for creating a desirable pink color are visible amounts of light-unstable dye selected from the group consisting of D&C Red #'s 21, 22, 27 and 28; FD&C Red #'s 2 and 3; C.I. Acid Red #'s 14 and 51; and mixtures thereof. In order to have a pink color, the level of dye in the product has to be low, typically between about 1 ppm and about 1,000 ppm, preferably between about 2 ppm and about 200 ppm, most preferably between about 3 ppm and about 25 ppm. At these low levels, loss of even a small portion of the dye drastically changes the appearance of the product. Accordingly, it is very important that the dyes not change color or lose color readily. Products containing these light unstable red dyes require packaging that prevents light from destroying the dyes. Suitable packaging is opaque or at least does not allow too much ultraviolet light to pass.

The preferred dye, D&C Red #28, is water-soluble, especially at higher pH, so that it does not tend to stain laundry. Moreover, it is stable under acid conditions so as to be stable in acid products packaged in protective packaging, but is unstable under exposure to light so that there is essentially no visual dye build-up on fabrics.

Other preferred light unstable dyes are FD&C Red #3 and D&C Red #22.

Many "pink" dyes are unsuitable for one or more reasons. Furthermore, blue products have been preferred commercially.

It is desirable to use other dyes to modify and control the color shade of some dyes, e.g., D&C Red #28. Polar Brilliant Blue is a desirable additive at ratios (D&C Red #28/Polar Brilliant Blue) of from about 200:1 to about 4:1, preferably from about 40:1 to about 6:1, most preferably from about 20:1 to about 8:1.

It is understood that any equivalent dye that is not certified, but that corresponds chemically to the above dyes, and especially D&C Red #28, are also included.

THE FABRIC SOFTENERS

The preferred fabric softener of the invention comprises the following:

Component I(a)

A preferred softening agent (active) of the present invention is the reaction products of higher fatty acids with a polyamine selected from the group consisting of hydroxyalkylalkylenediamines and dialkylenetriamines and mixtures thereof. These reaction products are mixtures of several compounds in view of the multifunctional structure of the polyamines (see, for example, the publication by H. W. Eckert in Fette-Seifen-Anstrichmittel, cited above).

The preferred Component I(a) is a nitrogenous compound selected from the group consisting of the reaction product mixtures or some selected components of the mixtures. More specifically, the preferred Component I(a) is compounds selected from the group consisting of:

(i) the reaction product of higher fatty acids with hydroxyalkylalkylenediamines in a molecular ratio of about 2:1, said reaction product containing a composition having a compound of the formula:

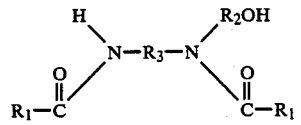

wherein $R_1$ is an acyclic aliphatic $C_{15}$–$C_{21}$ hydrocarbon group and $R_2$ and $R_3$ are divalent $C_1$–$C_3$ alkylene groups;

(ii) substituted imidazoline compounds having the formula:

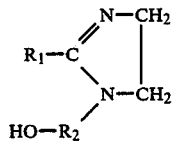

wherein $R_1$ and $R_2$ are defined as above;

(iii) substituted imidazoline compounds having the formula:

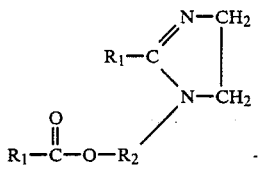

wherein $R_1$ and $R_2$ are defined as above;

(iv) the reaction product of higher fatty acids with dialkylenetriamines in a molecular ratio of about 2:1, said reaction product containing a composition having a compound of the formula:

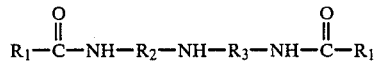

wherein $R_1$, $R_2$ and $R_3$ are defined as above; and (v) substituted imidazoline compounds having the formula:

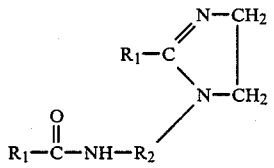

wherein $R_1$ and $R_2$ are defined as above; and mixtures thereof.

Component I(a)(i) is commercially available as Mazamide® 6, sold by Mazer Chemicals, or Ceranine® HC, sold by Sandoz Colors & Chemicals; here the higher fatty acids are hydrogenated tallow fatty acids and the hydroxyalkylalkylenediamine is N-2-hydroxyethylethylenediamine, and $R_1$ is an aliphatic $C_{15}$–$C_{17}$ hydrocarbon group, and $R_2$ and $R_3$ are divalent ethylene groups.

An example of Component I(a)(ii) is stearic hydroxyethyl imidazoline wherein $R_1$ is an aliphatic $C_{17}$ hydrocarbon group, $R_2$ is a divalent ethylene group; this chemical is sold under the trade names of Alkazine® ST by Alkaril Chemicals, Inc., or Schercozoline® S by Scher Chemicals, Inc.

An example of Component I(a)(iv) is N,N''-ditallowalkoyldiethylenetriamine where $R_1$ is an aliphatic $C_{15}$–$C_{17}$ hydrocarbon group and $R_2$ and $R_3$ are divalent ethylene groups.

An example of Component I(a)(v) is 1-tallowamidoethyl-2-tallowimidazoline wherein $R_1$ is an aliphatic $C_{15}$–$C_{17}$ hydrocarbon group and $R_2$ is a divalent ethylene group.

The component I(a)(v) can also be first dispersed in a Bronstedt acid dispersing aid having a pKa value of not greater than 6; provided that the pH of the final composition is not greater than 7. Some preferred dispersing aids are formic acid, phosphoric acid, or methylsulfonic acid.

Both N,N''-ditallowalkoyldiethylenetriamine and 1-tallowethylamido-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemical's Society, January 1978, pages 118–121). N,N''-ditallowalkoyldiethylenetriamine and 1-tallowamidoethyl-2-tallowimidazoline can be obtained from Sherex Chemical Company as experimental chemicals. Methyl-1-tallowamidoethyl-2-tallowimidazolinium methylsulfate is sold by Sherex Chemical Company under the trade name Varisoft® 475.

Component I(b)

The preferred Component I(b) is a cationic nitrogenous salt containing one long chain acyclic aliphatic $C_{15}$–$C_{22}$ hydrocarbon group selected from the group consisting of:

(i) acyclic quaternary ammonium salts having the formula:

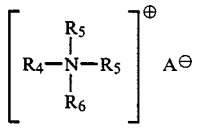

wherein $R_4$ is an acyclic aliphatic $C_{15}$–$C_{22}$ hydrocarbon group, $R_5$ and $R_6$ are $C_1$–$C_4$ saturated alkyl or hydroxyalkyl groups, and $A\theta$ is an anion;

(ii) substituted imidazolinium salts having the formula:

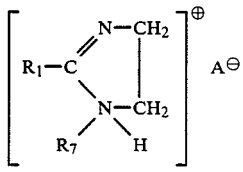

wherein $R_1$ is an acyclic aliphatic $C_{15}$–$C_{21}$ hydrocarbon group, $R_7$ is a hydrogen or a $C_1$–$C_4$ saturated alkyl or hydroxyalkyl group, and $A\theta$ is an anion;

(iii) substituted imidazolinium salts having the formula:

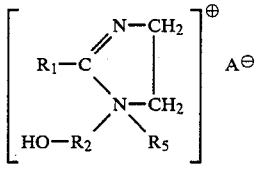

wherein $R_2$ is a divalent $C_1$–$C_3$ alkylene group and $R_1$, $R_5$ and $A\theta$ are as defined above;

(iv) alkylpyridinium salts having the formula:

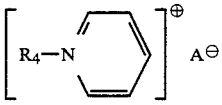

wherein $R_4$ is an acyclic aliphatic $C_{16}$–$C_{22}$ hydrocarbon group and $A\theta$ is an anion; and (v) alkanamide alkylene pyridinium salts having the formula:

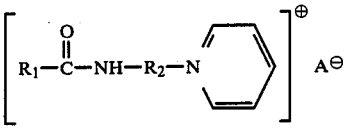

wherein $R_1$ is an acyclic aliphatic $C_{15}$–$C_{21}$ hydrocarbon group, $R_2$ is a divalent $C_1$–$C_3$ alkylene group, and $A\theta$ is an ion group; and mixtures thereof.

Examples of Component I(b)(i) are the monoalkyltrimethylammonium salts such as monotallowtrimethylammonium chloride, mono(hydrogenated tallow)-trimethylammonium chloride, palmityltrimethylammonium chloride and soyatrimethylammonium chloride, sold by Sherex Chemical Company under the trade names Adogen® 471, Adogen 441, Adogen 444, and Adogen 415, respectively. In these salts $R_4$ is an acyclic aliphatic $C_{16}$–$C_{18}$ hydrocarbon group, and $R_5$ and $R_6$ are methyl groups. Mono(hydrogenated tallow)-trimethylammonium chloride and monotallowtrimethylammonium chloride are preferred. Other examples of Component I(b)(i) are behenyltrimethylammonium chloride wherein $R_4$ is a $C_{22}$ hydrocarbon group and sold under the trade name Kemamine® Q2803-C by Humko Chemical Division of Witco Chemical Corporation; soyadimethylethylammonium ethosulfate wherein $R_4$ is a $C_{16}$–$C_{18}$ hydrocarbon group, $R_5$ is a methyl group, $R_6$ is an ethyl group, and A is an ethylsulfate anion, sold under the trade name Jordaquat® 1033 by Jordan Chemical Company; and methyl-bis(2-hydroxyethyl)octadecylammonium chloride wherein $R_4$ is a $C_{18}$ hydrocarbon group, $R_5$ is a 2-hydroxyethyl group and $R_6$ is a methyl group and available under the trade name Ethoquad® 18/12 from Armak Company.

An example of Component I(b)(iii) is 1-ethyl-1-(2-hydroxyethyl)-2-isoheptadecylimidazolinium ethylsulfate wherein $R_1$ is a $C_{17}$ hydrocarbon group, $R_2$ is an ethylene group, $R_5$ is an ethyl group, and A is an ethylsulfate anion. It is available from Mona Industries, Inc., under the trade name Monaquat® ISIES.

A preferred composition contains Component I(a) at a level of from about 50% to about 90% by weight of Component I and Component I(b) at a level of from about 10% to about 50% by weight of Component I.

Cationic Nitrogenous Salts I(c)

Preferred cationic nitrogenous salts having two or more long chain acyclic aliphatic $C_{15}$–$C_{22}$ hydrocarbon groups or one said group and an arylalkyl group are selected from the group consisting of:

(i) acyclic quaternary ammonium salts having the formula:

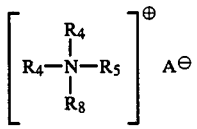

wherein $R_4$ is an acyclic aliphatic $C_{15}$–$C_{22}$ hydrocarbon group, $R_5$ is a $C_1$–$C_4$ saturated alkyl or hydroxyalkyl group, $R_8$ is selected from the group consisting of $R_4$ and $R_5$ groups, and $A\theta$ is an anion defined as above;

(ii) diamido quaternary ammonium salts having the formula:

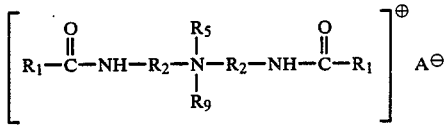

wherein $R_1$ is an acyclic aliphatic $C_{15}$–$C_{21}$ hydrocarbon group, $R_2$ is a divalent alkylene group having 1 to 3 carbon atoms, $R_5$ and $R_9$ are $C_1$–$C_4$ saturated alkyl or hydroxyalkyl groups, and $A\theta$ is an anion;

(iii) diamino alkoxylated quaternary ammonium salts having the formula:

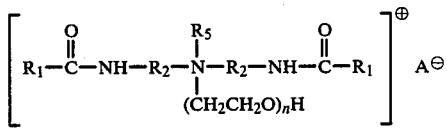

wherein n is equal to 1 to about 5, and $R_1$, $R_2$, $R_5$ and $A\theta$ are as defined above;

(iv) quaternary ammonium compounds having the formula:

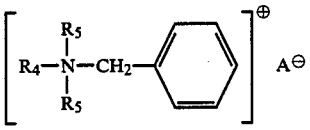

wherein $R_4$ is an acyclic aliphatic $C_{15}$–$C_{22}$ hydrocarbon group, $R_5$ is a $C_1$–$C_4$ saturated alkyl or hydroxyalkyl group, $A\theta$ is an anion;

(v) substituted imidazolinium salts having the formula:

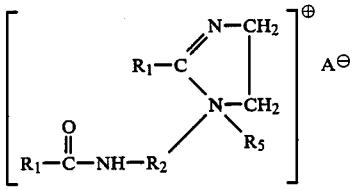

wherein $R_1$ is an acyclic aliphatic $C_{15}$–$C_{21}$ hydrocarbon group, $R_2$ is a divalent alkylene group having 1 to 3 carbon atoms, and $R_5$ and $A\theta$ are as defined above; and (vi) substituted imidazolinium salts having the formula:

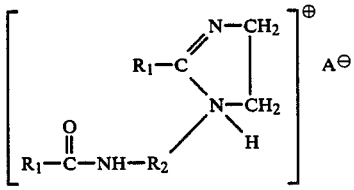

wherein $R_1$, $R_2$ and $A\theta$ are as defined above; and mixtures thereof.

Examples of Component I(c)(i) are the well-known dialkyldimethylammonium salts such as ditallowdimethylammonium chloride, ditallowdimethylammonium methylsulfate, di(hydrogenated tallow)dimethylammonium chloride, distearyldimethylammonium chloride, dibehenyldimethylammonium chloride. Di(hydrogenated tallow)dimethylammonium chloride and ditallowdimethylammonium chloride are preferred. Examples of commercially available dialkyldimethylammonium salts usable in the present invention are di(hydrogenated tallow) dimethylammonium chloride (trade name Adogen 442), ditallowdimethylammonium chloride (trade name Adogen 470), distearyldimethylammonium chloride (trade name Arosurf® TA-100), all available from Sherex Chemical Company. Dibehenyldimethylammonium chloride wherein $R_4$ is an acyclic aliphatic $C_{22}$ hydrocarbon group is sold under the trade name Kemamine Q-2802C by Humko Chemical Division of Witco Chemical Corporation.

Examples of Component I(c)(ii) are methylbis(tallowamidoethyl)(2-hydroxyethyl)ammonium methylsulfate and methylbis(hydrogenated tallowamidoethyl)(2-hydroxyethyl)ammonium methylsulfate wherein $R_1$ is an acyclic aliphatic $C_{15}$–$C_{17}$ hydrocarbon group, $R_2$ is an ethylene group, $R_5$ is a methyl group, $R_9$ is a hydroxyalkyl group and A is a methylsulfate anion; these materials are available from Sherex Chemical Company under the trade names Varisoft 222 and Varisoft 110, respectively.

An example of Component I(c)(iv) is dimethylstearylbenzylammonium chloride wherein $R_4$ is an acyclic aliphatic $C_{18}$ hydrocarbon group, $R_5$ is a methyl group and A is a chloride anion, and is sold under the trade names Varisoft SDC by Sherex Chemical Company and Ammonyx® 490 by Onyx Chemical Company.

Examples of Component I(c)(v) are 1-methyl-1-tallowamidoethyl-2-tallowimidazolinium methylsulfate and 1-methyl-1-(hydrogenated tallowamidoethyl)-2-(hydrogenated tallow)imidazolinium methylsulfate wherein $R_1$ is an acyclic aliphatic $C_{15}$–$C_{17}$ hydrocarbon group, $R_2$ is an ethylene group, $R_5$ is a methyl group and A is a chloride anion; they are sold under the trade names Varisoft 475 and Varisoft 445, respectively, by Sherex Chemical Company.

A preferred composition contains Component I(c) at a level of from about 10% to about 80% by weight of said Component I. A more preferred composition also contains Component I(c) which is selected from the group consisting of: (i) di(hydrogenated tallow)dimethylammonium chloride and (v) methyl-1-tallowamidoethyl-2-tallowimidazolinium methylsulfate; and mixtures thereof. A preferred combination of ranges for Component I(a) is from about 10% to about 80% and for Component I(b) from about 8% to about 40% by weight of Component I.

Where Component I(c) is present, Component I is preferably present at from about 4% to about 27% by weight of the total composition. More specifically, this composition is more preferred wherein Component I(a) is the reaction product of about 2 moles of hydrogenated tallow fatty acids with about 1 mole of N-2-hydroxyethylethylenediamine and is present at a level of from about 10% to about 70% by weight of Component I; and wherein Component I(b) is mono(hydrogenated tallow)trimethylammonium chloride present at a level of from about 8% to about 20% by weight of Component I; and wherein Component I(c) is selected from the group consisting of di(hydrogenated tallow)dimethylammonium chloride, ditallowdiemthylammonium chloride and methyl-1-tallowamidoethyl-2-tallowimidazolinium methylsulfate, and mixtures thereof; said Component I(c) is present at a level of from about 20% to about 75% by weight of Component I; and wherein the weight ratio of said di(hydrogenated tallow)dimethylammonium chloride to said methyl-1-tallowamidoethyl-2-tallowimidazolinium methylsulfate is from about 2:1 to about 6:1.

The above individual components can also be used individually, especially those of I(c).

ANION A

In the cationic nitrogenous salts herein, the anion $A\theta$ provides electrical neutrality. Most often, the anion used to provide electrical neutrality in these salts is a halide, such as fluoride, chloride, bromide, or iodide. However, other anions can be used, such as methylsulfate, ethylsulfate, hydroxide, acetate, formate, sulfate, carbonate, and the like. Chloride and methylsulfate are preferred herein as anion A.

Other fabric softeners that can be used herein, typically in combination with the preferred fabric softener are disclosed in U.S. Pat. Nos. 3,861,870, Edwards and Diehl; 4,308,151, Cambre; 3,886,075, Bernardino; 4,233,164, Davis; 4,401,578, Verbruggen; 3,974,076, Wiersema and Rieke; and 4,237,016, Rudkin, Clint, and Young, all of said patents being incorporated herein by reference.

LIQUID CARRIER

The liquid carrier is selected from the group consisting of water and mixtures of the water and short chain $C_1$–$C_4$ monohydric alcohols. Water used can be distilled, deionized, or tap water. Mixtures of water and up to about 15% of a short chain alcohol such as ethanol, propanol, isopropanol or butanol, and mixtures thereof, are also useful as the carrier liquid.

OPTIONAL INGREDIENTS

Adjuvants can be added to the compositions herein for their known purposes. Such adjuvants include, but are not limited to, viscosity control agents, perfumes, emulsifiers, preservatives, antioxidants, bacteriocides, fungicides, brighteners, opacifiers, freeze-thaw control agents, soil release agents, deodorants, shrinkage control agents, and agents to provide ease of ironing. These adjuvants, if used, are added at their usual levels, generally each of up to about 5% by weight of the composition.

Viscosity control agents can be organic or inorganic in nature. Examples of organic viscosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides of the group IA and IIA metals of the Periodic Table of the Elements, e.g., calcium chloride, magnesium chloride, sodium chloride, potassium bromide, and lithium chloride. Calcium chloride is preferred. The ionizable salts are particularly useful during the process of mixing the ingredients to made the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 6,000 parts per million (ppm), preferably from about 20 to about 4,000 ppm by weight of the composition.

Examples of bacteriocides used in the compositions of this invention are glutaraldehyde, formaldehyde, 2-bromo-2-nitropropane-1,3-diol sold by Inolex Chemicals under the trade name Bronopol ®, and a mixture of 5-chloro-2-methyl-4-isothiazolin-3-one and 2-methyl-4-isothiazoline-3-one sold by Rohm and Haas Company under the trade name Kathon ® CG/ICP. Typical levels of bateriocides used in the present compositions are from about 1 to about 1,000 ppm by weight of the composition.

Examples of antioxidants that can be added to the compositions of this invention are propyl gallate, availale from Eastman Chemical Products, Inc., under the trade names Tenox ® PG and Tenox S-1, and butylated hydroxy toluene, available from UOP Process Division under the trade name Sustane ® BHT.

The present compositions may contain silicones to provide additional benefits such as ease of ironing and improved fabric feel. The preferred silicones are polydimethylsiloxanes of viscosity of from about 100 centistokes (cs) to about 100,000 cs, preferably from about 200 cs to about 60,000 cs. These silicones can be used as is, or can be conveniently added to the softener compositions in a preemulsified form which is obtainable directly from the suppliers. Examples of these preemulsified silicones are 60% emulsion of polydimethylsiloxane (350 cs) sold by Dow Corning Corporation under the trade name DOW CORNING ® 1157 Fluid and 50% emulsion of polydimethylsiloxane (10,000 cs) sold by General Electric Company under the trade name General Electric ® SM 2140 Silicones. The optional silicone component can be used in an amount of from about 0.1% to about 6% by weight of the composition.

Soil release agents, usually polymers, are desirable additives at levels of from about 0.1% to about 5%. Suitable soil release agents are disclosed in U.S. Pat. Nos. 4,702,857, Gosselink, issued Oct. 27, 1987; 4,711,730, Gosselink and Diehl, issued Dec. 8, 1987; 4,713,194, Gosselink issued Dec. 15, 1987; and mixtures thereof, said patents being incorporated herein by reference. Other soil release polymers are disclosed in U.S. Pat. No. 4,749,596, Evans, Huntington, Stewart, Wolf, and Zimmerer, issued June 7, 1988, said patent being incorporated herein by reference.

Other minor components include short chain alcohols such as ethanol and isopropanol which are present in the commercially available quaternary ammonium compounds used in the preparation of the present compositions. The short chain alcohols are normally present at from about 1% to about 10% by weight of the composition.

A preferred composition contains from about 0.2% to about 2% of perfume, from 0% to about 3% of polydimethylsiloxane, from 0% to about 0.4% of calcium chloride, from about 1 ppm to about 1,000 ppm of bacteriocide, from about 10 ppm to about 100 ppm of dye, and from 0% to about 10% of short chain alcohols, by weight of the total composition.

The pH of the compositions of this invention is generally adjusted to be less than about 4, preferably from about 2 to about 4, more preferably from about 2.5 to about 4. Adjustment of pH is normally carried out by including a small quantity of free acid in the formulation. Because no strong pH buffers are present, only small amounts of acid are required. Any acidic material can be used; its selection can be made by anyone skilled in the softener arts on the basis of cost, availability, safety, etc. Among the acids that can be used are hydrochloric, sulfuric, phosphoric, citric, maleic, and succinic. For the purposes of this invention, pH is measured by a glass electrode in the softening composition without dilution in comparison with a standard calomel reference electrode.

The liquid fabric softening compositions of the present invention can be prepared by convenional methods. A convenient and satisfactory method is to prepare the softening active premix at about 72°-77° C., which is then added with stirring to the hot water seat. The dye is then added. Temperature-sensitive optional components can be added after the fabric softening composition is cooled to a lower temperature.

The liquid fabric softening compositions of this invention are used by adding to the rinse cycle of conventional home laundry operations. Generally, rinse water has a temperature of from about 5° C. to about 60° C. The concentration of the fabric softener actives of this invention is generally from about 10 ppm to about 200 ppm, preferably from about 25 ppm to about 100 ppm, by weight of the aqueous rinsing bath.

In general, the present invention in its fabric softening method aspect comprises the steps of (1) washing fabrics in a conventional washing machine with a detergent composition; and (2) rinsing the fabrics in a bath which contains the abovedescribed amounts of the fabric softeners; and (3) drying the fabrics. When multiple rinses are used, the fabric softening composition is preferably added to the final rinse. Fabric drying can take place either in an automatic dryer or in the open air.

All percentages, ratios, and parts herein are by weight unless otherwise indicated.

| | EXAMPLES | | |
|---|---|---|---|
| Ingredient | A Wt. % | B Wt. % | C Wt. % |
| Adogen ® 448E-83HM[1] | 7.97 | 7.97 | 4.54 |
| Varisoft ® 445 Imidazoline[2] | 6.21 | 6.21 | 3.40 |
| Adogen ® 441[3] | 0.97 | 0.97 | 0.57 |
| Polydimethyl Siloxane (55%) | 0.61 | 0.61 | 0.324 |
| Silicone DC 1520 (20%) | 0.015 | 0.015 | 0.015 |
| Perfume | 0.90 | 0.90 | 0.42 |
| Varonic ® T 220 D | 0.43 | 0.43 | 0.10 |
| Kathon ® (1.5%) | 0.034 | 0.034 | 0.034 |
| Tenox ® S-1 | 0.025 | 0.025 | — |
| Hydrochloric Acid (31.5%) | 1.25 | 1.25 | 0.62 |
| Calcium Chloride 25% Solution | 0.12 | 0.12 | 4.0 ppm |
| D&C Red #28 | 7.5 ppm | 7.5 ppm | 3.0 ppm |
| Polar Brilliant Blue | 0.5 ppm | 0.5 ppm | 0 |
| Soil Release Polymer[4] | 0 | 1.0 | 0 |
| Water | Balance | Balance | Balance |

[1]A mixture of ditallowalkyl dimethylammonium chloride and monotallowalkyl trimethylammonium chloride.
[2]Di long chain (tallow) alkyl imidazolinium softner.
[3]Monotallowalkyl trimethylammonium chloride.
[4]POET - The polyoxyethylene terephthalate compound of Example 8 of allowed U.S. Pat. Appln Ser. No. 022,615,supra, now, U.S. Pat. No. 4,749,596, issued June 7, 1988 incorporated herein by reference.

| | EXAMPLES - Continued | |
|---|---|---|
| Ingredient | D Wt. % | E Wt. % |
| Adogen ® 448E-83HM[1] | 4.54 | 4.54 |
| Varisoft ® 445 Imidazoline[2] | 3.40 | 3.40 |
| Adogen ® 441[3] | 0.57 | 0.57 |

-continued

| Ingredient | EXAMPLES - Continued D Wt. % | E Wt. % |
|---|---|---|
| Polydimethyl Siloxane (55%) | 0.324 | 0.324 |
| Silicone DC 1520 (20%) | 0.015 | 0.015 |
| Perfume | 0.42 | 0.42 |
| Varonic ® T 220 D | 0.10 | 0.10 |
| Kathon ® (1.5%) | 0.034 | 0.034 |
| Tenox ® S-1 | — | — |
| Hydrochloric Acid (31.5%) | 0.62 | 0.62 |
| Calcium Chloride 25% Solution | 4.0 ppm | 4.0 ppm |
| FD&C Red #3 | 10 ppm | — |
| D&C Red #22 | — | 15 ppm |
| Water | Balance | Balance |

[1]A mixture of ditallowalkyl dimethylammonium chloride and monotallowalkyl trimethylammonium chloride.
[2]Di long chain (tallow) alkyl imidazolinium softner.
[3]Monotallowalkyl trimethylammonium chloride.

The pH of each of these softener compositions is about 2.7 and desirable pink colors are produced.

The base product is made by a process that is similar to processes used for commercial products and the dyes are simply added to the finished product.

What is claimed is:

1. A fabric softening composition in the form of an aqueous dispersion comprising from about 3% to about 35% by weight of fabric softener and from about 1 ppm to about 1,000 ppm of a dye system which comprises a visible amount of a light-unstable dye selected from the group consisting of D&C Reds #'s 21, 22, 27 and 28; FD&C Reds #'s 2 and 3; C.I. Acid Reds #'s 14 and 51; and mixtures thereof; the pH of the composition being less than about 7, and the said fabric softening composition being packaged in a container that protects said light unstable dyes from light.

2. The composition of claim 1 wherein the pH is from about 2 to about 4 and the dye is present at a level of from about 2 ppm to about 200 ppm.

3. The composition of claim 2 wherein the dye system contains Polar Brilliant Blue and D&C Red #28 in ratios of D&C Red #28 to Polar Brilliant Blue of from about 200:1 to about 4:1, and the pH is less than about 4.

4. The composition of claim 3 wherein said ratios are from about 40:1 to about 6:1.

5. The composition of claim 4 wherein said ratios are from about 20:1 to about 8:1.

6. The composition of claim 1 wherein the dye system contains Polar Brilliant Blue and D&C Red #28 in ratios of D&C Red #28 to Polar Brilliant Blue of from about 200:1 to about 4:1, and the pH is less than about 4.

7. The composition of claim 6 wherein said ratios are from about 40:1 to about 6:1.

8. The composition of claim 7 wherein said ratios are from about 20:1 to about 8:1.

9. The composition of claim 1 wherein the dye system comprises dye selected from the group consisting of: FD&C Red #3; D&C Red #22; D&C Red #28 and mixtures thereof.

10. The composition of claim 9 wherein the dye system comprises FD&C Red #3.

11. The composition of claim 9 wherein the dye system comprises D&C Red #22.

12. The composition of claim 9 wherein the dye system comprises D&C Red #28.

* * * * *